US007093926B2

(12) United States Patent
Gil

(10) Patent No.: US 7,093,926 B2
(45) Date of Patent: Aug. 22, 2006

(54) PRINTHEAD ARRANGEMENT

(75) Inventor: Antoni Gil, Sabadell (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 233 days.

(21) Appl. No.: 10/620,878

(22) Filed: Jul. 16, 2003

(65) Prior Publication Data

US 2005/0012780 A1 Jan. 20, 2005

(51) Int. Cl.
*B41J 2/21* (2006.01)

(52) U.S. Cl. ..... 347/43; 347/41; 347/15

(58) Field of Classification Search ..... 347/13, 347/42, 15, 43, 41, 16, 12, 40
See application file for complete search history.

(56) References Cited

U.S. PATENT DOCUMENTS 4,593,295 A 6/1986 Matsufuji et al.
5,455,610 A 10/1995 Harrington
5,654,744 A 8/1997 Nicoloff, Jr. et al.
5,808,635 A 9/1998 Kneezel et al.
5,821,957 A 10/1998 Berge et al.
6,254,217 B1 7/2001 Askeland et al.
6,315,387 B1 11/2001 Horikoshi
6,322,206 B1 11/2001 Boyd et al.
6,428,145 B1 8/2002 Feinn et al.
2002/0051033 A1* 5/2002 Kubota et al. ..... 347/43
2004/0021734 A1* 2/2004 Otsuki ..... 347/43
2004/0104965 A1* 6/2004 Mitsuzawa ..... 347/43

* cited by examiner

*Primary Examiner*—Lamson Nguyen

(57) ABSTRACT

A printhead assembly include a carrier, a first plurality of printhead dies each mounted on the carrier and adapted to print a first color, and a second plurality of printhead dies each mounted on the carrier and adapted to print a second color. Each of the first plurality of printhead dies are offset from and partially overlap an adjacent one of the first plurality of printhead dies, and each of the second plurality of printhead dies are offset from and partially overlap an adjacent one of the second plurality of printhead dies.

35 Claims, 6 Drawing Sheets

PRINTHEAD ARRANGEMENT

BACKGROUND OF THE INVENTION

An inkjet printing system, as one embodiment of a fluid ejection system, may include a printhead, an ink supply which supplies liquid ink to the printhead, and an electronic controller which controls the printhead. The printhead, as one embodiment of a fluid ejection device, ejects ink drops through a plurality of orifices or nozzles and toward a print medium, such as a sheet of paper, so as to print onto the print medium. Typically, the orifices are arranged in one or more arrays such that properly sequenced ejection of ink from the orifices causes characters or other images to be printed upon the print medium as the printhead and the print medium are moved relative to each other.

In one arrangement, commonly referred to as a wide-array inkjet printing system, a plurality of individual printheads, also referred to as printhead dies, are mounted on a single substrate. As such, a number of nozzles and, therefore, an overall number of ink drops which can be ejected per second is increased. Since the overall number of drops which can be ejected per second is increased, printing speed can be increased with the wide-array inkjet printing system.

An inkjet printing system may print a number of different ink colors. In one arrangement, the different ink colors include black, cyan, yellow, and magenta from which a wide gamut of colors and/or shades of colors may be produced. One such system may include a different printhead or print cartridge for each color ink, thereby resulting in at least four different components for the four ink colors. Another such system may use one printhead or print cartridge for black ink and a different multi-color printhead or print cartridge for cyan, yellow, and magenta inks. While the black printhead or print cartridge may be identical to that of the previous system, the multi-color printhead or print cartridge is different, thereby resulting in at least five different components between the two systems. A manufacturer which sells both of these systems, therefore, will need to supply these five different components.

In addition, a color shade is often dependent on the order in which the various different color ink drops which form the shade are deposited on the print medium. Some systems with printheads or print cartridges as described above may produce undesirable results since the order of ink drop deposition may vary between one portion of the print medium printed to be a given color shade and another portion of the print medium printed to be the same color shade.

For these and other reasons, there is a need for the present invention.

SUMMARY OF THE INVENTION

One aspect of the present invention provides a printhead assembly. The printhead assembly includes a carrier, a first plurality of printhead dies each mounted on the carrier and adapted to print a first color, and a second plurality of printhead dies each mounted on the carrier and adapted to print a second color. Each of the first plurality of printhead dies are offset from and partially overlap an adjacent one of the first plurality of printhead dies, and each of the second plurality of printhead dies are offset from and partially overlap an adjacent one of the second plurality of printhead dies.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
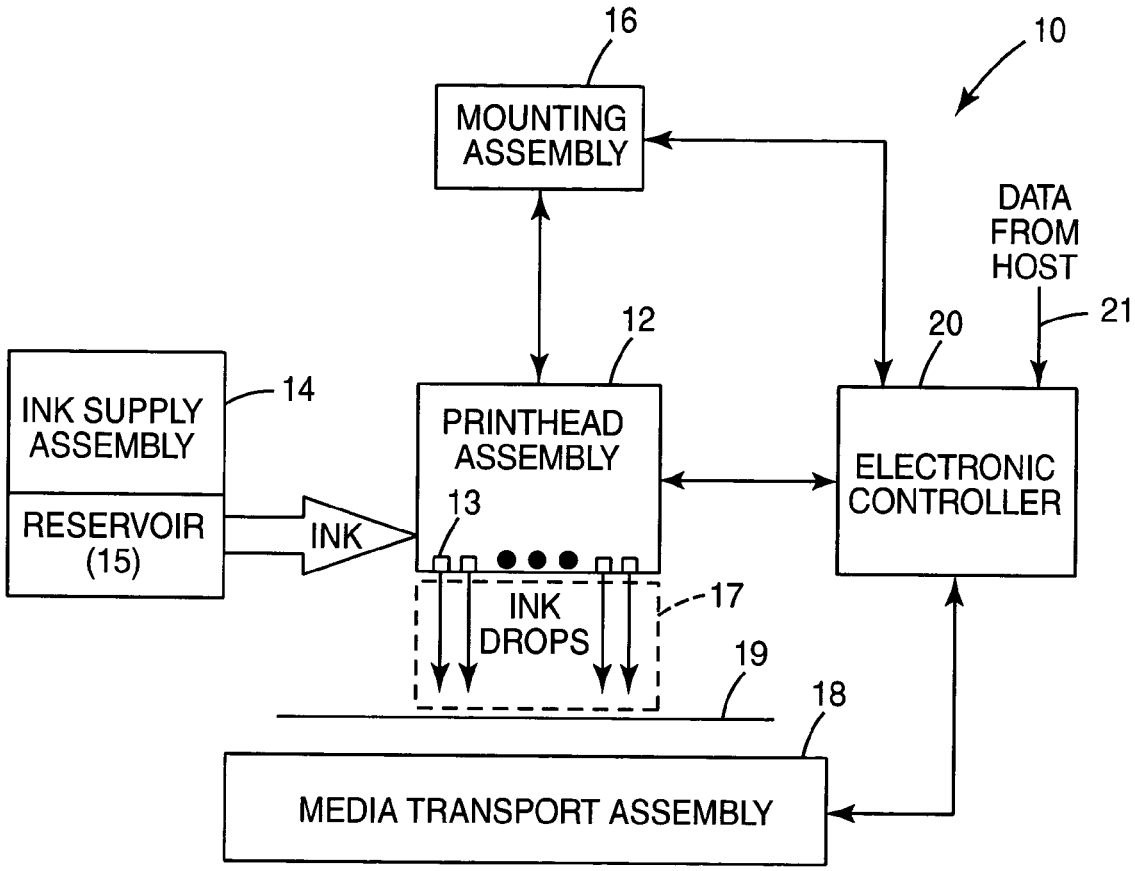
FIG. 1 is a block diagram illustrating one embodiment of an inkjet printing system.

FIG. 1 illustrates one embodiment of an inkjet printing system 10 according to the present invention. Inkjet printing system 10 constitutes one embodiment of a fluid ejection system which includes a fluid ejection assembly, such as an inkjet printhead assembly 12, and a fluid supply assembly, such as an ink supply assembly 14. In the illustrated embodiment, inkjet printing system 10 also includes a mounting assembly 16, a media transport assembly 18, and an electronic controller 20.

Inkjet printhead assembly 12, as one embodiment of a fluid ejection assembly, is formed according to an embodiment of the present invention, and includes one or more printheads or fluid ejection devices which eject drops of ink or fluid through a plurality of orifices or nozzles 13. In one embodiment, the drops are directed toward a medium, such as print medium 19, so as to print onto print medium 19.

Print medium 19 may be any type of suitable sheet material, such as paper, card stock, transparencies, Mylar, and the like. Typically, nozzles 13 are arranged in one or more columns or arrays such that properly sequenced ejection of ink from nozzles 13 causes, in one embodiment, characters, symbols, and/or other graphics or images to be printed upon print medium 19 as inkjet printhead assembly 12 and print medium 19 are moved relative to each other.

Ink supply assembly 14, as one embodiment of a fluid supply assembly, supplies ink to printhead assembly 12 and includes a reservoir 15 for storing ink. As such, in one embodiment, ink flows from reservoir 15 to inkjet printhead assembly 12. In one embodiment, inkjet printhead assembly 12 and ink supply assembly 14 are housed together in an inkjet or fluidjet cartridge or pen. In another embodiment, ink supply assembly 14 is separate from inkjet printhead assembly 12 and supplies ink to inkjet printhead assembly 12 through an interface connection, such as a supply tube (not shown).

Mounting assembly 16 positions inkjet printhead assembly 12 relative to media transport assembly 18, and media transport assembly 18 positions print medium 19 relative to inkjet printhead assembly 12. Thus, a print zone 17 is defined adjacent to nozzles 13 in an area between inkjet printhead assembly 12 and print medium 19. In one embodiment, inkjet printhead assembly 12 is a scanning type printhead assembly and mounting assembly 16 includes a carriage (not shown) for moving inkjet printhead assembly 12 relative to media transport assembly 18. In another embodiment, inkjet printhead assembly 12 is a non-scanning type printhead assembly and mounting assembly 16 fixes inkjet printhead assembly 12 at a prescribed position relative to media transport assembly 18.

Electronic controller 20 communicates with inkjet printhead assembly 12, mounting assembly 16, and media transport assembly 18. Electronic controller 20 receives data 21 from a host system, such as a computer, and usually includes memory for temporarily storing data 21. Typically, data 21 is sent to inkjet printing system 10 along an electronic, infrared, optical or other information transfer path. Data 21 represents, for example, a document and/or file to be printed. As such, data 21 forms a print job for inkjet printing system 10 and includes one or more print job commands and/or command parameters.

In one embodiment, electronic controller 20 provides control of inkjet printhead assembly 12 including timing control for ejection of ink drops from nozzles 13. As such, electronic controller 20 defines a pattern of ejected ink drops which form characters, symbols, and/or other graphics or images on print medium 19. Timing control and, therefore, the pattern of ejected ink drops is determined by the print job commands and/or command parameters. In one embodiment, at least a portion of logic and drive circuitry forming a portion of electronic controller 20 is located on inkjet printhead assembly 12. In another embodiment, at least a portion of logic and drive circuitry is located off inkjet printhead assembly 12.

Figure 2:
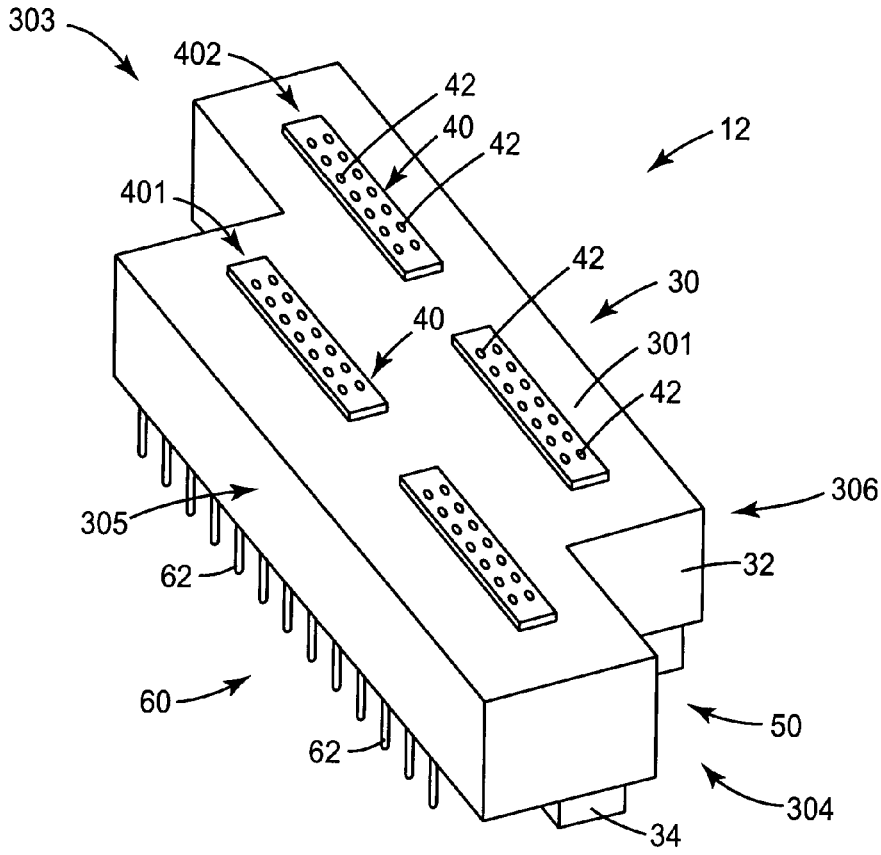
FIG. 2 is a top perspective view illustrating one embodiment of an inkjet printhead assembly.
Figure 3:
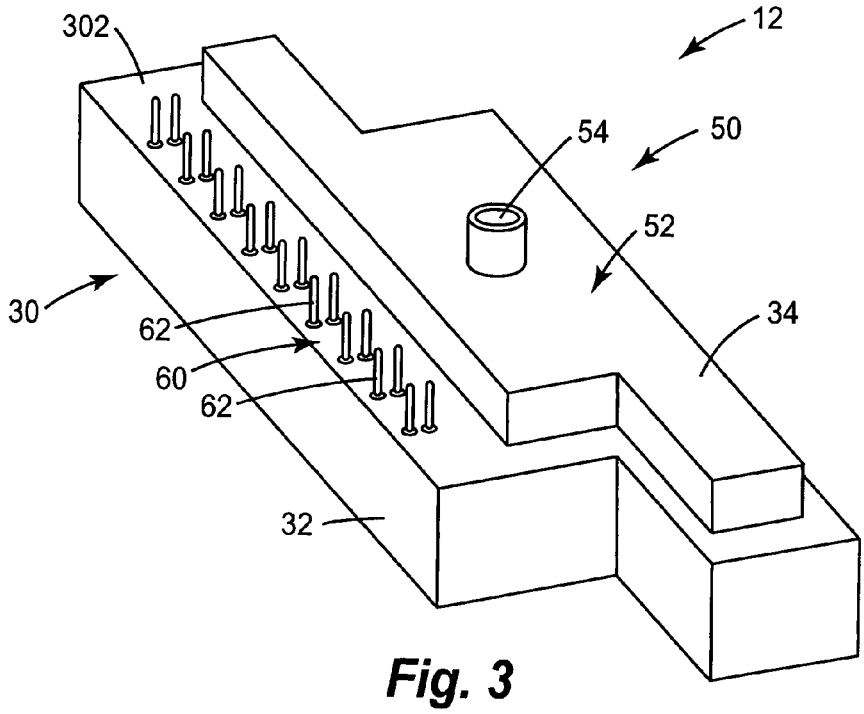
FIG. 3 is a bottom perspective view of the inkjet printhead assembly of FIG. 2.

FIGS. 2 and 3 illustrate one embodiment of a portion of inkjet printhead assembly 12. Inkjet printhead assembly 12 is a wide-array or multi-head printhead assembly and includes a carrier 30, a plurality of printhead dies 40, an ink delivery system 50, and an electronic interface system 60. Carrier 30 has an exposed surface or first face 301 and an exposed surface or second face 302 which is opposite of and oriented substantially parallel with first face 301. In addition, carrier 30 includes opposite ends 303 and 304, and opposite sides 305 and 306.

Carrier 30 serves to carry or provide mechanical support for printhead dies 40. In addition, carrier 30 accommodates fluidic communication between ink supply assembly 14 and printhead dies 40 via ink delivery system 50 and accommodates electrical communication between electronic controller 20 and printhead dies 40 via electronic interface system 60.

Printhead dies 40 are mounted on first face 301 of carrier 30 and aligned in one or more rows. In one embodiment, for example, printhead dies 40 are arranged on carrier 30 so as to form two rows 401 and 402. While four printhead dies 40 are illustrated as being mounted on carrier 30, the number of printhead dies 40 mounted on carrier 30, as well as the number of rows, may vary.

In one embodiment, printhead dies 40 are spaced apart and staggered such that printhead dies 40 in one row overlap at least one printhead die 40 in another row. For example, each printhead die 40 in row 401 overlaps at least one printhead die 40 in row 402. Thus, inkjet printhead assembly 12 may span a nominal page width or a width shorter or longer than nominal page width. For example, inkjet printhead assembly 12 may span 8.5 inches of a Letter size print medium or a distance greater than or less than 8.5 inches of the Letter size print medium.

In one embodiment, a plurality of inkjet printhead assemblies 12 are mounted in an end-to-end manner. For example, inkjet printhead assemblies 12 are mounted such that end 304 of one inkjet printhead assembly 12 is adjacent end 303 of another inkjet printhead assembly 12.

In another embodiment, as described below, a plurality of inkjet printhead assemblies 12 are mounted in a side-to-side manner. For example, inkjet printhead assemblies 12 are mounted such that side 306 of one inkjet printhead assembly 12 is adjacent side 305 of another inkjet printhead assembly 12. As such, as described below, inkjet printhead assemblies 12 are in-line and fully overlap. Thus, printhead dies 40 of one inkjet printhead assembly 12 are in-line with and fully overlap printhead dies 40 of another inkjet printhead assembly 12.

In one embodiment, to provide for at least one printhead die 40 of one inkjet printhead assembly 12 overlapping at least one printhead die 40 of an adjacent inkjet printhead assembly 12 when inkjet printhead assemblies 12 are mounted in an end-to-end manner, carrier 30 has a staggered or stair-step profile. While carrier 30 is illustrated as having a stair-step profile, it is within the scope of the present invention for carrier 30 to have other profiles including a substantially rectangular profile.

Ink delivery system 50 fluidically couples ink supply assembly 14 with printhead dies 40. In one embodiment, ink delivery system 50 includes a fluid manifold 52 and at least one port 54. Fluid manifold 52 is formed in carrier 30 and includes one or more chambers for distributing ink through carrier 30 to each printhead die 40. Port 54 communicates with fluid manifold 52 and provides an inlet for ink supplied by ink supply assembly 14. Fluid manifold 52 may be formed as described, for example, in U.S. patent application Ser. No. 10/283,836 entitled "Fluid Interconnect for Printhead Assembly" assigned to the assignee of the present invention.

Electronic interface system 60 electrically couples electronic controller 20 with printhead dies 40. In one embodiment, electronic interface system 60 includes a plurality of electrical contacts 62 which form input/output (I/O) contacts for electronic interface system 60. As such, electrical contacts 62 provide points for communicating electrical signals between electronic controller 20 and inkjet printhead assembly 12. Examples of electrical contacts 62 include I/O pins which engage corresponding I/O receptacles electrically coupled to electronic controller 20 and I/O contact pads or fingers which mechanically or inductively contact corresponding electrical nodes electrically coupled to electronic controller 20. Although electrical contacts 62 are illustrated as being provided on second face 302 of carrier 30, it is within the scope of the present invention for electrical contacts 62 to be provided on other sides of carrier 30.

Figure 4:
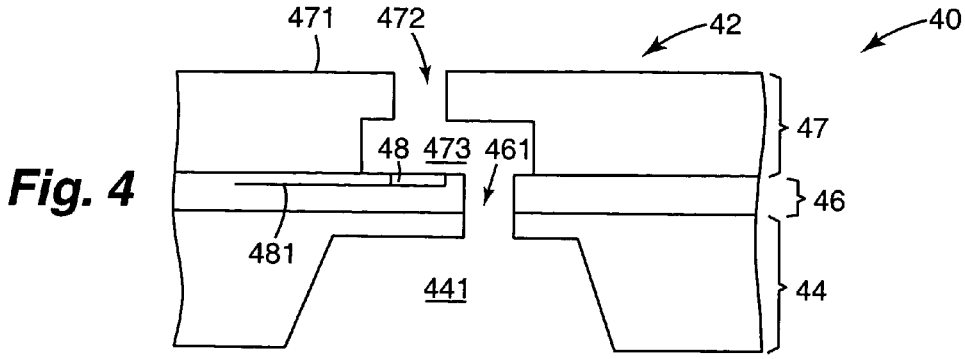
FIG. 4 is a schematic cross-sectional view illustrating portions of one embodiment of a printhead die.

As illustrated in the embodiment of FIGS. 2 and 4, each printhead die 40 includes an array of drop ejecting elements 42. Drop ejecting elements 42 are formed on a substrate 44 which has a fluid (or ink) feed slot 441 formed therein. As such, fluid feed slot 441 provides a supply of fluid (or ink) to drop ejecting elements 42. Substrate 44 is formed, for example, of silicon, glass, or a stable polymer.

In one embodiment, each drop ejecting element 42 includes a thin-film structure 46 with a firing resistor 48 and an orifice layer 47. Thin-film structure 46 has a fluid (or ink) feed channel 461 formed therein which communicates with fluid feed slot 441 of substrate 44. Orifice layer 47 has a front face 471 and a nozzle opening 472 formed in front face 471. Orifice layer 47 also has a nozzle chamber 473 formed therein which communicates with nozzle opening 472 and fluid feed channel 461 of thin-film structure 46. Firing resistor 48 is positioned within nozzle chamber 473 and includes leads 481 which electrically couple firing resistor 48 to a drive signal and ground.

Thin-film structure 46 is formed, for example, by one or more passivation or insulation layers of silicon dioxide, silicon carbide, silicon nitride, tantalum, poly-silicon glass, or other suitable material. In one embodiment, thin-film structure 46 also includes a conductive layer which defines firing resistor 48 and leads 481. The conductive layer is formed, for example, by aluminum, gold, tantalum, tantalum-aluminum, or other metal or metal alloy.

In one embodiment, during operation, fluid flows from fluid feed slot 441 to nozzle chamber 473 via fluid feed channel 461. Nozzle opening 472 is operatively associated with firing resistor 48 such that droplets of fluid are ejected from nozzle chamber 473 through nozzle opening 472 (e.g., normal to the plane of firing resistor 48) and toward a medium upon energization of firing resistor 48.

Example embodiments of printhead dies 40 include a thermal printhead, as previously described, a piezoelectric printhead, a flex-tensional printhead, or any other type of fluidjet ejection device known in the art. In one embodiment, printhead dies 40 are fully integrated thermal inkjet printheads.

Figure 5:
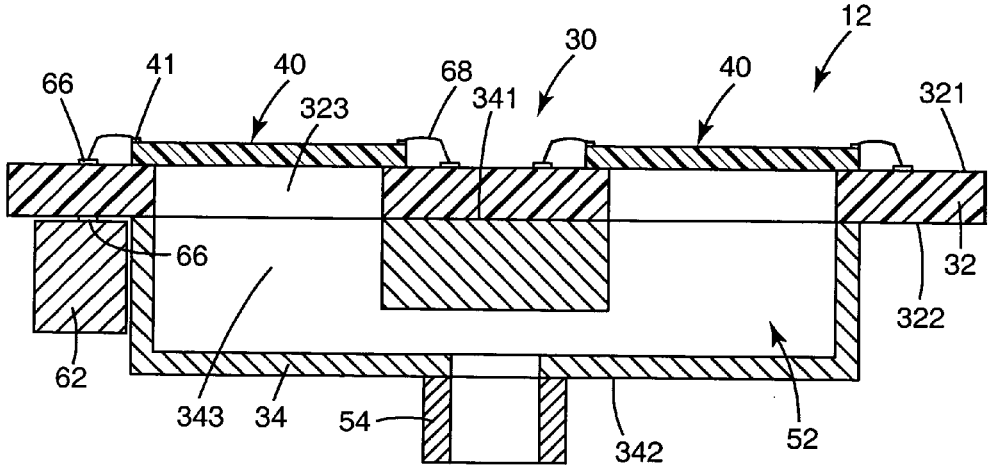
FIG. 5 is a schematic cross-sectional view illustrating one embodiment of an inkjet printhead assembly.

Referring to the embodiments of FIGS. 2, 3, and 5, carrier 30 includes a substrate 32 and a substructure 34. Substrate 32 and substructure 34 provide and/or accommodate mechanical, electrical, and fluidic functions of inkjet printhead assembly 12. More specifically, substrate 32 provides mechanical support for printhead dies 40, accommodates fluidic communication between ink supply assembly 14 and printhead dies 40 via ink delivery system 50, and provides electrical connection between and among printhead dies 40 and electronic controller 20 via electronic interface system 60. Substructure 34 provides mechanical support for substrate 32, accommodates fluidic communication between ink supply assembly 14 and printhead dies 40 via ink delivery system 50, and accommodates electrical connection between printhead dies 40 and electronic controller 20 via electronic interface system 60.

Substrate 32 has a first side 321 and a second side 322 which is opposite first side 321, and substructure 34 has a first side 341 and a second side 342 which is opposite first side 341. In one embodiment, printhead dies 40 are mounted on first side 321 of substrate 32 and substructure 34 is disposed on second side 322 of substrate 32. As such, first side 341 of substructure 34 contacts and is joined to second side 322 of substrate 32.

For transferring ink between ink supply assembly 14 and printhead dies 40, substrate 32 and substructure 34 each have a plurality of ink or fluid passages 323 and 343, respectively, formed therein. Fluid passages 323 extend through substrate 32 and provide a through-channel or through-opening for delivery of ink to printhead dies 40 and, more specifically, fluid feed slot 441 of substrate 44 (FIG. 4). Fluid passages 343 extend through substructure 34 and provide a through-channel or through-opening for delivery of ink to fluid passages 323 of substrate 32. As such, fluid passages 323 and 343 form a portion of ink delivery system 50. Although only one fluid passage 323 is shown for a given printhead die 40, there may be additional fluid passages to the same printhead die, for example, to provide ink of respective differing colors.

In one embodiment, substructure 34 is formed of a non-ceramic material such as plastic. It is, however, within the scope of the present invention for substructure 34 to be formed of silicon, stainless steel, or other suitable material or combination of materials. Preferably, substructure 34 is chemically compatible with fluid such as, for example, liquid ink, so as to accommodate fluidic routing.

Figure 6:
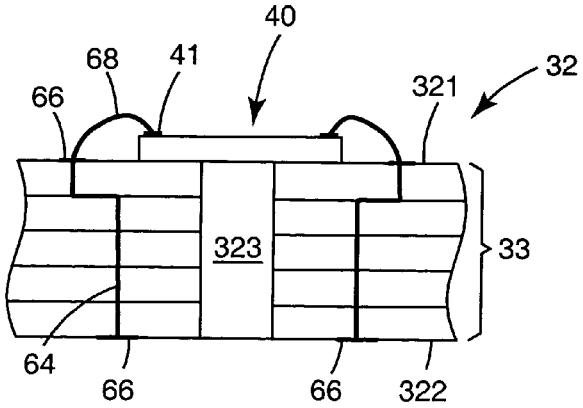
FIG. 6 is a schematic cross-sectional view illustrating one embodiment of a portion of a substrate for an inkjet printhead assembly.

In one embodiment, for transferring electrical signals between electronic controller 20 and printhead dies 40, electronic interface system 60 includes a plurality of conductive paths 64 extending through substrate 32, as illustrated in FIG. 6. More specifically, substrate 32 includes conductive paths 64 which pass through and terminate at exposed surfaces of substrate 32. In one embodiment, conductive paths 64 include electrical contact pads 66 at terminal ends thereof which form, for example, I/O bond pads on substrate 32. Conductive paths 64, therefore, terminate at and provide electrical coupling between electrical contact pads 66.

Electrical contact pads 66 provide points for electrical connection to substrate 32 and, more specifically, conductive paths 64. Electrical connection is established, for example, via electrical connectors or contacts 62, such as I/O pins or spring fingers, wire bonds, electrical nodes, and/or other suitable electrical connectors. In one embodiment, printhead dies 40 include electrical contacts 41 which form I/O bond pads. As such, electronic interface system 60 includes electrical connectors, for example, wire bond leads 68, which electrically couple electrical contact pads 66 with electrical contacts 41 of printhead dies 40.

Conductive paths 64 transfer electrical signals between electronic controller 20 and printhead dies 40. More specifically, conductive paths 64 define transfer paths for power, ground, and data among and/or between printhead dies 40 and electrical controller 20. In one embodiment, data includes print data and non-print data.

In one embodiment, as illustrated in FIG. 6, substrate 32 includes a plurality of layers 33 each formed of a ceramic material. As such, substrate 32 includes circuit patterns which pierce layers 33 to form conductive paths 64. While substrate 32 is illustrated as including layers 33, it is, however, within the scope of the present invention for substrate 32 to be formed of a solid pressed ceramic material. As such, conductive paths are formed, for example, as thin-film metallized layers on the pressed ceramic material.

While conductive paths 64 are illustrated as terminating at first side 321 and second side 322 of substrate 32, it is, however, within the scope of the present invention for conductive paths 64 to terminate at other sides of substrate 32. In addition, one or more conductive paths 64 may branch from and/or lead to one or more other conductive paths 64. Furthermore, one or more conductive paths 64 may begin and/or end within substrate 32. Conductive paths 64 may be formed as described, for example, in U.S. Pat. No. 6,428,145, entitled "Wide-Array inkjet Printhead Assembly with Internal Electrical Routing System" assigned to the assignee of the present invention.

It is to be understood that FIGS. 5 and 6 are simplified schematic illustrations of one embodiment of carrier 30, including substrate 32 and substructure 34. The illustrative routing of fluid passages 323 and 343 through substrate 32 and substructure 34, respectively, and conductive paths 64 through substrate 32, for example, has been simplified for clarity of the invention. Although various features of carrier 30, such as fluid passages 323 and 343 and conductive paths 64, are schematically illustrated as being straight, it is understood that design constraints could make the actual geometry more complicated for a commercial embodiment of inkjet printhead assembly 12. For example, to allow multiple colorants of ink to be channeled through carrier 30 to printhead dies 40, as described below, fluid passages 323 and 343 have more complicated geometries. In addition, conductive paths 64 may have more complicated routing geometries through substrate 32 to avoid contact with fluid passages 323 and to allow for electrical connector geometries other than the illustrated I/O pins. It is understood that such alternatives are within the scope of the present invention.

Figure 7:
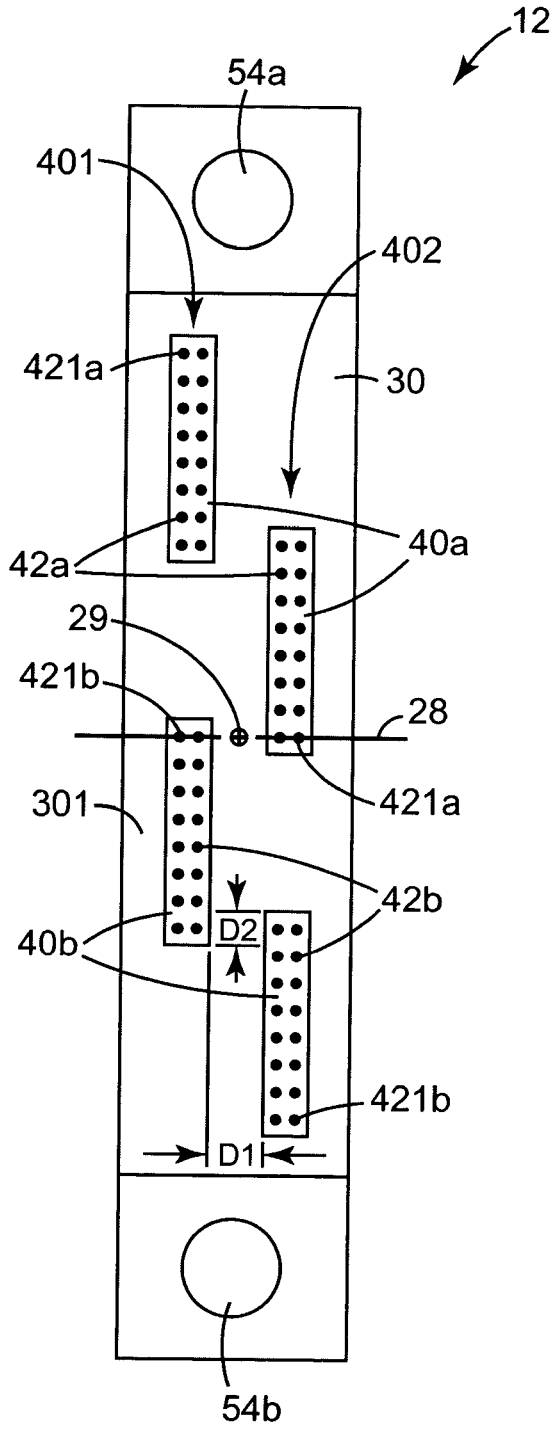
FIG. 7 is a schematic illustration of one embodiment of an inkjet printhead assembly.

In one embodiment, as illustrated in FIG. 7, printhead assembly 12 includes a first plurality of printhead dies 40*a* and a second plurality of printhead dies 40*b*. Printhead dies 40*a* and 40*b* are mounted on carrier 30 and are aligned in one or more rows. For example, printhead dies 40*a* and 40*b* are arranged on carrier 30 so as to form two rows 401 and 402. As such, each printhead die 40*a* in row 401 is aligned with each printhead die 40*b* in row 401 and each printhead die 40*a* in row 402 is aligned with each printhead die 40*b* in row 402.

In one embodiment, printhead dies 40*a* and 40*b* are offset and staggered such that printhead dies 40*a* partially overlap adjacent printhead dies 40*a*, and printhead dies 40*b* partially overlap adjacent printhead dies 40*b*. As such, printhead dies 40*a* and printhead dies 40*b* can create print swaths of increased height relative to a single printhead die. In addition, one printhead die 40*a* is offset from and partially overlaps one printhead die 40*b*.

As illustrated in the embodiment of FIG. 7, printhead dies 40*a* and 40*b* each include at least one column of nozzles 42*a* and 42*b*, respectively. In one embodiment, printhead dies 40*a* and 40*b* are offset from adjacent printhead dies 40*a* and 40*b*, respectively, by a distance D1 in a first direction (i.e., horizontally as illustrated in FIG. 7). In addition, printhead dies 40*a* and 40*b* partially overlap adjacent printhead dies 40*a* and 40*b*, respectively, by a distance D2 in a second direction substantially perpendicular to the first direction (i.e., vertically as illustrated in FIG. 7).

In one embodiment, printhead assembly 12 includes an axis 28 oriented substantially perpendicular to the column of nozzles 42*a* and 42*b*, and an axis 29 oriented substantially perpendicular to axis 28 (i.e., in and out of the plane of the page). As such, axis 29 is oriented substantially perpendicular to face 301 of carrier 30.

In one embodiment, printhead assembly 12 is substantially symmetrical about axis 29. As such, mounting of printhead assembly 12, for example, is consistent when printhead assembly 12 is inverted or rotated 180 degrees about axis 29. Thus, orientation of printhead assembly 12 may be reversed.

In one embodiment, printhead dies 40*a* are substantially symmetrical with printhead dies 40*b* about axis 29. More specifically, printhead dies 40*a* and 40*b* are arranged and mounted on carrier 30 such that printhead dies 40*b* coincide with printhead dies 40*a* when rotated 180 degrees about axis 29. For example, in the embodiment illustrated in FIG. 7, nozzles 42*a* and 42*b* of printhead dies 40*a* and 40*b* each include a nozzle 421*a* and 421*b*, respectively, identified as nozzle one. As such, printhead dies 40*a* and 40*b* are arranged and mounted on carrier 30 such that nozzles 42*a* and 42*b* of printhead dies 40*a* and 40*b* are substantially symmetrical about axis 29.

In one embodiment, printhead dies 40*a* and 40*b* print different colors. More specifically, printhead dies 40*a* print a first color and printhead dies 40*b* print a second color. In one embodiment, for example, printhead dies 40*a* print one of black, cyan, light cyan, yellow, magenta, and light magenta and printhead dies 40*b* print another of black, cyan, light cyan, yellow, magenta, and light magenta. Since printhead dies 40*a* and printhead dies 40*b* partially overlap each other, printhead dies 40*a* can print and create a print swath for a first color within a first area and printhead dies 40*b* can print and create a print swath for a second color within a second area adjacent to and partially overlapping the first area.

In the embodiment illustrated in FIG. 7, printhead assembly 12 includes a first inlet 54*a* and a second inlet 54*b*. As such, inlet 54*a* communicates with a first color and inlet 54*b* communicates with a second color. In addition, fluid manifold 52 (FIGS. 3 and 5) includes a first chamber or cavity which communicates with printhead dies 40*a* and inlet 54*a* to supply the first color to printhead dies 40*a*, and a second chamber or cavity which communicates with printhead dies 40*b* and inlet 54*b* to supply the second color to printhead dies 40*b*. While inlets 54*a* and 54*b* are illustrated as being at opposite ends of printhead assembly 12, it is understood that other configurations of inlets 54*a* and 54*b* are possible and, therefore, within the scope of the present invention.

Figure 8:
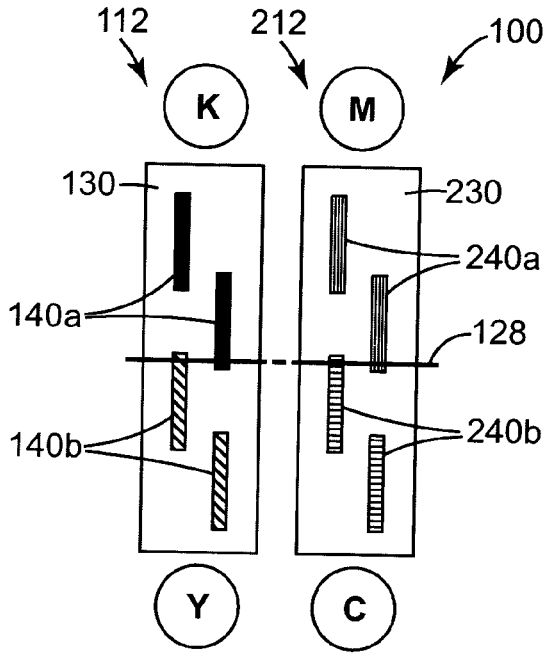
FIG. 8 is a schematic illustration of one embodiment of a printhead arrangement including the inkjet printhead assembly of FIG. 7.

FIG. 8 illustrates one embodiment of a printhead arrangement 100 including a plurality of printhead assemblies formed according to an embodiment of the present invention. Printhead arrangement 100 includes a first printhead assembly 112 and a second printhead assembly 212. Printhead assembly 112 and printhead assembly 212 are each formed according to an embodiment of the present invention and include a first plurality of printhead dies 140*a* and a second plurality of printhead dies 140*b*, and a third plurality of printhead dies 240*a* and a fourth plurality of printhead dies 240*b*, respectively. As such, printhead dies 140*a* and printhead dies 140*b* are mounted on a carrier 130 of printhead assembly 112, and printhead dies 240*a* and printhead dies 240*b* are mounted on a carrier 230 of printhead assembly 212. Printhead dies 140*a* and printhead dies 140*b*, and printhead dies 240*a* and printhead dies 240*b* are positioned and mounted on carrier 130 and carrier 230, respectively, in a manner similar to how printhead dies 40*a* and 40*b* are mounted on carrier 30, as described above with reference to FIG. 7.

In one embodiment, as illustrated in FIG. 8, printhead assembly 112 and printhead assembly 212 are arranged so as to be in-line and fully overlap. More specifically, printhead assembly 112 and printhead assembly 212 are substantially aligned along an axis 128. As such, printhead dies 140*a* of printhead assembly 112 and printhead dies 240*a* of printhead assembly 212 are in-line and fully overlap, and printhead dies 140*b* of printhead assembly 112 and printhead dies 240*b* of printhead assembly 212 are in-line and fully overlap. Thus, printhead dies 140*a* and 240*a* can print within a first area, and printhead dies 140*b* and 240*b* can print within a second area adjacent to and partially overlapping the first area.

In one embodiment, printhead dies 140*a*, 140*b*, 240*a*, and 240*b* print different colors. More specifically, printhead dies 140*a* print a first color, printhead dies 140*b* print a second color, printhead dies 240*a* print a third color, and printhead dies 240*b* print a fourth color. In one embodiment, for example, printhead dies 140*a* print black, printhead dies 140*b* print yellow, printhead dies 240*a* print magenta, and printhead dies 240*b* print cyan. It is understood, however, that other colors and/or arrangements of colors are within the scope of the present invention.

Figure 9:
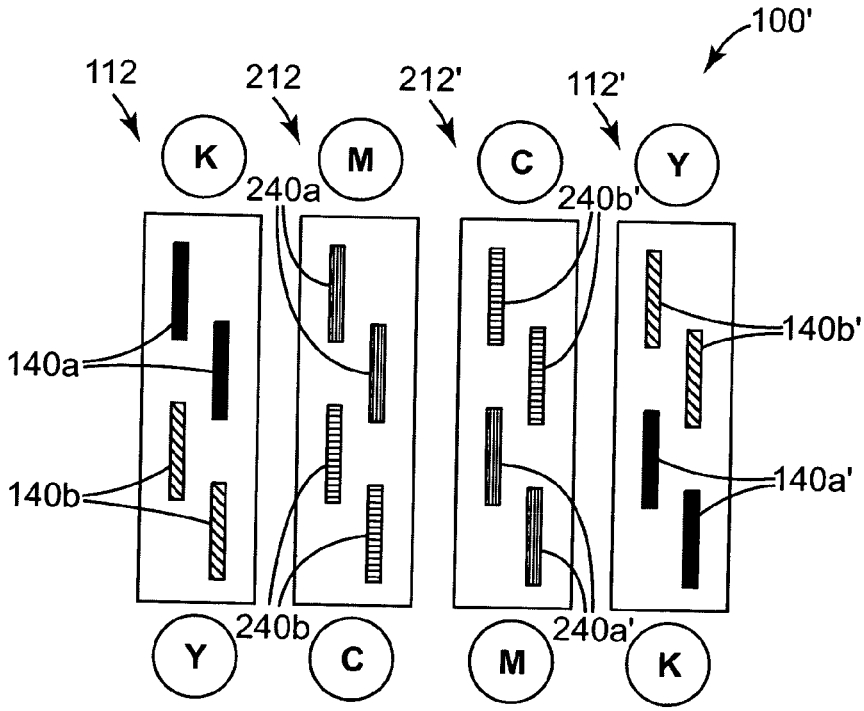
FIG. 9 is a schematic illustration of another embodiment of a printhead arrangement including the inkjet printhead assembly of FIG. 7.

FIG. 9 illustrates another embodiment of a printhead arrangement 100' including a plurality of printhead assemblies formed according to an embodiment of the present invention. Printhead arrangement 100', similar to printhead arrangement 100, includes first printhead assembly 112 and second printhead assembly 212. Printhead arrangement 100', however, includes an additional first printhead assembly 112' and an additional second printhead assembly 212'. As such, printhead assembly 112 includes printhead dies 140*a* and 140*b*, printhead assembly 212 includes printhead dies 240*a* and 240*b*, printhead assembly 112' includes printhead dies 140*a'* and 140*b'*, and printhead assembly 212' includes printhead dies 240*a'* and 240*b'*.

In one embodiment, as illustrated in FIG. 9, printhead assembly 112, printhead assembly 212, printhead assembly 112', and printhead assembly 212' are arranged so as to be in-line and fully overlap. In addition, printhead assembly 112' and printhead assembly 212' are inverted or rotated 180 degrees relative to printhead assembly 112 and printhead assembly 212, respectively. More specifically, the orientation of printhead assembly 112' and printhead assembly 212' is reversed from that of printhead assembly 112 and printhead assembly 212, respectively. As such, the order of printhead dies 140*a'* and 140*b'* of printhead assembly 112' and printhead dies 240*a'* and 240*b'* of printhead assembly 212' is reversed from that of printhead dies 140*a* and 140*b* of printhead assembly 112 and printhead dies 240*a* and 240*b* of printhead assembly 212, respectively.

In one embodiment, printhead assemblies 112, 212, 112', and 212' are substantially symmetrical, as described above with reference to printhead assembly 12 (FIG. 7). As such, printhead dies 140*a* of printhead assembly 112, printhead dies 240*a* of printhead assembly 212, printhead dies 140*b'* of printhead assembly 112', and printhead dies 240*b'* of printhead assembly 212' are in-line and fully overlap. In addition, printhead dies 140*b* of printhead assembly 112, printhead dies 240*b* of printhead assembly 212, printhead dies 140*a'* of printhead assembly 112', and printhead dies 240*a'* of printhead assembly 212' are in-line and fully overlap. Thus, printhead dies 140*a*, 240*a*, 140*b'*, and 240*b'* can print and create a print swath within a first area and printhead dies 140*b*, 240*b*, 140*a'*, and 240*a'* can print and create a print swath within a second area partially overlapping the first area.

In one embodiment, printhead dies 140*a*, 140*b*, 240*a*, and 240*b* print different colors, as described above. In addition, printhead dies 140*a'*, 140*b'*, 240*a'*, and 240*b'* print different colors. In one embodiment, printhead dies 140*a'* print the same color as printhead dies 140*a*, printhead dies 140*b'* print the same color as printhead dies 140*b*, printhead dies 240*a'* print the same color as printhead dies 240*a*, and printhead dies 240*b'* print the same color as printhead dies 240*b*.

In one embodiment, for example, printhead dies 140*a* and 140*a'* print black, printhead dies 140*b* and 140*b'* print yellow, printhead dies 240*a* and 240*a'* print magenta, and printhead dies 240*b* and 240*b'* print cyan. Since printhead assembly 112' and printhead assembly 212' are inverted relative to printhead assembly 112 and printhead assembly 212, and printhead dies 140*a* and 140*a'* print the same color (e.g., black), printhead dies 140*b* and 140*b'* print the same color (e.g., yellow), printhead dies 240*a* and 240*a'* print the same color (e.g., magenta), and printhead dies 240*b* and 240*b'* print the same color (e.g., cyan), printhead dies 140*a*, 240*a*, 140*b'*, and 240*b'* can print a swath including all four colors and printhead dies 140*b*, 240*b*, 140*a'*, and 240*a'* can print a swath including all four colors.

In the embodiment illustrated in FIG. 9, printhead assembly 212 is positioned in-line between printhead assembly 112 and printhead assembly 212', and printhead assembly 212' is positioned in-line between printhead assembly 212 and printhead assembly 112'. As such, when inkjet printing system 10 is a scanning type printing system, printhead dies 140*a*, 240*a*, 240*b'* and 140*b'* can print the colors of a swath including four different colors (e.g., black, magenta, cyan, and yellow) in one order as printhead arrangement 100' is scanned in a first direction relative to a print medium, and printhead dies 140*a'*, 240*a'*, 240*b*, and 140*b* can print the colors of a swath including the same four different colors (e.g., black, magenta, cyan, and yellow) in the same order as printhead arrangement 100' is scanned in a second direction opposite the first direction relative to the print medium.

For example, with reference to the embodiment illustrated in FIG. 9, printhead dies 140*b'*, 240*b'*, 240*a*, and 140*a* can print the four different colors in the order of yellow, then cyan, then magenta and then black, respectively, when printhead arrangement 100' is scanned in a direction left to right, and printhead dies 140*b*, 240*b*, 240*a'*, and 140*a'* can print the four different colors in the same order of yellow, then cyan, then magenta, and then black, respectively, when printhead arrangement 100' is scanned in an opposite direction right to left. As such, hue shift which may result when different colors are deposited in different orders may be reduced.

Figure 10:
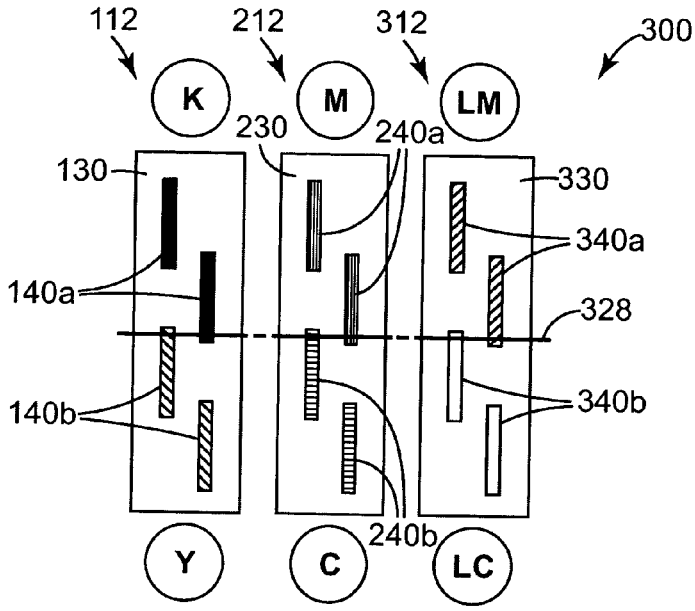
FIG. 10 is a schematic illustration of another embodiment of a printhead arrangement including the inkjet printhead assembly of FIG. 7.

FIG. 10 illustrates another embodiment of a printhead arrangement including a plurality of printhead assemblies formed according to an embodiment of the present invention. In addition to first printhead assembly 112 and second printhead assembly 212, printhead arrangement 300 also includes a third printhead assembly 312. Printhead assembly 112 and printhead assembly 212 include printhead dies 140*a* and 140*b* and printhead dies 240*a* and 240*b*, respectively, as described above, while printhead assembly 312 includes printhead dies 340*a* and 340*b*. Printhead dies 340*a* and 340*b* are positioned and mounted on a carrier 330 in a manner similar to how printhead dies 40*a* and 40*b* are mounted on carrier 30, as described above with reference to FIG. 7.

In one embodiment, as illustrated in FIG. 10, printhead assembly 112, printhead assembly 212, and printhead assembly 312 are arranged so as to be in-line and fully overlap. More specifically, printhead assembly 112, printhead assembly 212, and printhead assembly 312 are substantially aligned along an axis 328. As such, printhead dies 140*a* of printhead assembly 112, printhead dies 240*a* of printhead assembly 212, and printhead dies 340*a* of printhead assembly 312 are in-line and fully overlap. In addition, printhead dies 140*b* of printhead assembly 112, printhead dies 240*b* of printhead assembly 212, and printhead dies 340*b* of printhead assembly 312 are in-line and fully overlap. Thus, printhead dies 140*a*, 240*a*, and 340*a* can print within a first area, and printhead dies 140*b*, 240*b*, and 340*b* can print within a second area adjacent to and partially overlapping the first area.

In one embodiment, printhead dies 140*a*, 140*b*, 240*a*, 240*b*, 340*a*, and 340*b* print different colors. More specifically, printhead dies 140*a* print a first color, printhead dies 140*b* print a second color, printhead dies 240*a* print a third color, printhead dies 240*b* print a fourth color, printhead dies 340*a* print a fifth color, and printhead dies 340*b* print a sixth color. In one embodiment, for example, printhead dies 140*a* print black, printhead dies 140*b* print yellow, printhead dies 240*a* print magenta, printhead dies 240*b* print cyan, printhead dies 340*a* print light magenta, and printhead dies 340*b* print light cyan. It is understood, however, that other colors and/or arrangements of colors are within the scope of the present invention.

Figure 11:
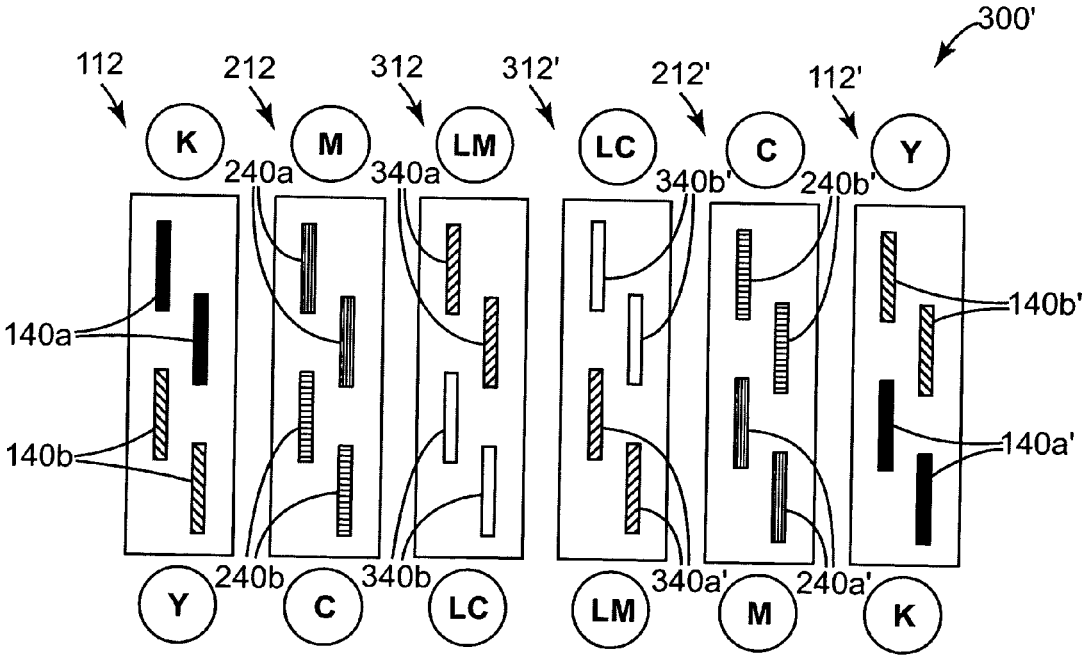
FIG. 11 is a schematic illustration of another embodiment of a printhead arrangement including the inkjet printhead assembly of FIG. 7.

FIG. 11 illustrates another embodiment of a printhead arrangement including a plurality of printhead assemblies formed according to an embodiment of the present invention. Printhead arrangement 300', similar to printhead arrangement 300, includes first printhead assembly 112, second printhead assembly 212, and third printhead assembly 312. In addition, printhead arrangement 300', similar to printhead arrangement 100', includes an additional first printhead assembly 112' and an additional second printhead assembly 212', as well as an additional third printhead assembly 312'. As such, printhead assembly 112 includes printhead dies 140*a* and 140*b*, printhead assembly 212 includes printhead dies 240*a* and 240*b*, printhead assembly 312 includes printhead dies 340*a* and 340*b*, printhead assembly 112' includes printhead dies 140*a'* and 140*b'*, printhead assembly 212' includes printhead dies 240*a'* and 240*b'*, and printhead assembly 312' includes printhead dies 340*a'* and 340*b'*.

In one embodiment, as illustrated in FIG. 11, printhead assembly 112, printhead assembly 212, printhead assembly 312, printhead assembly 112', printhead assembly 212', and printhead assembly 312' are arranged so as to be in-line and fully overlap. In addition, printhead assembly 112', printhead assembly 212', and printhead assembly 312' are inverted or rotated 180 degrees relative to printhead assembly 112, printhead assembly 212, and printhead assembly 312, respectively.

In one embodiment, printhead dies 140*a*, 140*b*, 240*a*, and 240*b* print different colors, and printhead dies 140*a'*, 140*b'*, 240*a'*, and 240*b'* print different colors, as described above, while printhead dies 340*a* and 340*b* print different colors, and printhead dies 340*a'* and 340*b'* print different colors. For example, printhead dies 140*a* and 140*a'* print black, printhead dies 140*b* and 140*b'* print yellow, printhead dies 240*a* and 240*a'* print magenta, printhead dies 240*b* and 240*b'* print cyan, printhead dies 340*a* and 340*a'* print light magenta, and printhead dies 340*b* and 340*b'* print light cyan.

In the embodiment illustrated in FIG. 11, printhead assembly 312 is positioned in-line between printhead assembly 212 and printhead assembly 312', and printhead assembly 312' is positioned in-line between printhead assembly 312 and printhead assembly 212'. As such, when inkjet printing system 10 is a scanning type printing system, printhead dies 140*a*, 240*a*, 340*a*, 340*b'*, 240*b'* and 140*b'* can print the colors of a swath including six different colors (e.g., black, magenta, light magenta, light cyan, cyan, and yellow) in one order as printhead arrangement 300' is scanned in a first direction relative to a print medium, and printhead dies 140*a'*, 240*a'*, 340*a'*, 340*b'*, 240*b*, and 140*b* can print the colors of a swath including the same six different colors (e.g., black, magenta, light magenta, light cyan, cyan, and yellow) in the same order as printhead arrangement 300' is scanned in a second direction opposite the first direction relative to the print medium.

While printhead arrangement 100 is illustrated as including two printhead assemblies 112 and 212 which are capable of printing four colors (e.g., black, magenta, cyan, and yellow), and printhead arrangement 300 is illustrated as including three printhead assemblies 112, 212, and 312 which are capable of printing six colors (e.g., black, magenta, light magenta, light cyan, cyan, and yellow), it is understood that additional printhead assemblies may be provided to print additional colors. It is understood that such alternatives are within the scope of the present invention.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A printhead arrangement, comprising:

a first printhead assembly including a first carrier, a first plurality of printhead dies each mounted on the first carrier and adapted to print a first color, and a second plurality of printhead dies each mounted on the first carrier and adapted to print a second color; and a second printhead assembly including a second carrier, a third plurality of printhead dies each mounted on the second carrier and adapted to print a third color, and a fourth plurality of printhead dies each mounted on the second carrier and adapted to print a fourth color, wherein the first printhead assembly and the second printhead assembly are in-line and fully overlap.

2. The printhead arrangement of claim 1, wherein the first plurality of printhead dies and the third plurality of printhead dies are in-line and fully overlap, and the second plurality of printhead dies and the fourth plurality of printhead dies are in-line and fully overlap.

3. The printhead arrangement of claim 1, wherein each of the first plurality of printhead dies are offset from and partially overlap an adjacent one of the first plurality of printhead dies, each of the second plurality of printhead dies are offset from and partially overlap an adjacent one of the second plurality of printhead dies, each of the third plurality of printhead dies are offset from and partially overlap an adjacent one of the third plurality of printhead dies, and each of the fourth plurality of printhead dies are offset from and partially overlap an adjacent one of the fourth plurality of printhead dies.

4. The printhead arrangement of claim 1, wherein the first plurality of printhead dies and the second plurality of printhead dies are mounted on a face of the first carrier, and the third plurality of printhead dies and the fourth plurality of printhead dies are mounted on a face of the second carrier, and wherein the first printhead assembly is substantially symmetrical about an axis oriented substantially perpendicular to the face of the first carrier, and the second printhead assembly is substantially symmetrical about an axis oriented substantially perpendicular to the face of the second carrier.

5. The printhead arrangement of claim 1, wherein the first plurality of printhead dies and the third plurality of printhead dies are adapted to print within a first area when the second plurality of printhead dies and the fourth plurality of printhead dies are adapted to print within a second area.

6. The printhead arrangement of claim 5, wherein the first area and the second area partially overlap.

7. The printhead arrangement of claim 1, further comprising:

an additional first printhead assembly; and an additional second printhead assembly, wherein the additional first printhead assembly and the additional second printhead assembly are both in-line with and fully overlap both the first printhead assembly and the second printhead assembly.

8. The printhead arrangement of claim 7, wherein the additional second printhead assembly is positioned between the second printhead assembly and the additional first printhead assembly.

9. The printhead arrangement of claim 7, wherein the additional first printhead assembly and the additional second printhead assembly are inverted relative to the first printhead assembly and the second printhead assembly.

10. The printhead arrangement of claim 9, wherein the first plurality of printhead dies of the first printhead assembly, the third plurality of printhead dies of the second printhead assembly, the additional fourth plurality of printhead dies of the additional second printhead assembly, and the additional second plurality of printhead dies of the additional first printhead assembly are arranged in a first order in a first direction, and the additional first plurality of printhead dies of the additional first winthead assembly, the additional third plurality of printhead dies of the additional second printhead assembly, the fourth plurality of printhead dies of the second printhead assembly, and the second plurality of printhead dies of the first printhead assembly are arranged in the first order in a second direction opposite the first direction.

11. The printhead arrangement of claim 7, wherein the additional first printhead assembly includes an additional first carrier, an additional first plurality of printhead dies each mounted on the additional first carrier and adapted to print the first color, and an additional second plurality of printhead dies each mounted on the additional first carrier and adapted to print the second color, and wherein the additional second printhead assembly includes an additional second carrier, an additional third plurality of printhead dies each mounted on the additional second carrier and adapted to print the third color, and an additional fourth plurality of printhead dies each mounted on the additional second carrier and adapted to print the fourth color.

12. The printhead arrangement of claim 1, further comprising:

a third printhead assembly including a third carrier, a fifth plurality of printhead dies each mounted on the third carrier and adapted to print a fifth color, and a sixth plurality of printhead dies each mounted on the third carrier and adapted to print a sixth color, wherein the first printhead assembly, the second printhead assembly, and the third printhead assembly are in-line and fully overlap.

13. The printhead arrangement of claim 12, wherein the first plurality of printhead dies, the third plurality of printhead dies, and the fifth plurality of printhead dies are in-line and fully overlap, and the second plurality of printhead dies, the fourth plurality of printhead dies, and the sixth plurality of printhead dies are in-line and fully overlap.

14. A method of forming a printhead arrangement, the method comprising:

forming a first printhead assembly, including providing a first carrier, mounting a first plurality of printhead dies each adapted to print a first color on the first carrier, and mounting a second plurality of printhead dies each adapted to print a second color on the first carrier;

forming a second printhead assembly, including providing a second carrier, mounting a third plurality of printhead dies each adapted to print a third color on the second carrier, and mounting a fourth plurality of printhead dies each adapted to print a fourth color on the second carrier; and positioning the first printhead assembly and the second printhead assembly in-line, including fully overlapping the first printhead assembly and the second printhead assembly.

15. The method of claim 14, wherein mounting the first plurality and the second plurality of printhead dies on the first carrier includes offsetting and partially overlapping each of the first plurality and the second plurality of printhead dies with an adjacent one of the first plurality and the second plurality of printhead dies, and mounting the third plurality and the fourth plurality of printhead dies on the second carrier includes offsetting and partially overlapping each of the third plurality and the fourth plurality of printhead dies with an adjacent one of the third plurality and the fourth plurality of printhead dies.

16. The method of claim 14, wherein mounting the first plurality and the second plurality of printhead dies on the first carrier includes symmetrically mounting the second plurality of printhead dies with the first plurality of printhead dies about an axis oriented substantially perpendicular to a face of the first carrier, and mounting the third plurality and the fourth plurality of printhead dies on the second carrier includes symmetrically mounting the fourth plurality of printhead dies with the third plurality of printhead dies about an axis oriented substantially perpendicular to a face of the second carrier.

17. The method of claim 14, further comprising:

forming an additional first printhead assembly;

forming an additional second printhead assembly; and positioning the additional first printhead assembly and the additional second printhead assembly in-line with the first printhead assembly and the second printhead assembly, including fully overlapping the first printhead assembly, the second printhead assembly, the additional first printhead assembly, and the additional second printhead assembly.

18. The method of claim 17, wherein positioning the additional first printhead assembly and the additional second printhead assembly includes positioning the additional second printhead assembly between the second printhead assembly and the additional first printhead assembly.

19. The method of claim 17, wherein positioning the additional first printhead assembly and the additional second printhead assembly includes inverting the additional first printhead assembly and the additional second printhead assembly relative to the first printhead assembly and the second printhead assembly.

20. The method of claim 14, wherein the first color includes one of black, cyan, yellow, and magenta, the second color includes another of black, cyan, yellow, and magenta, the third color includes another of black, cyan, yellow, and magenta, and the fourth color includes another of black, cyan, yellow, and magenta.

21. The method of claim 14, further comprising:

forming a third printhead assembly, including providing a third carrier, mounting a fifth plurality of printhead dies each adapted to print a fifth color on the third carrier, and mounting a sixth plurality of printhead dies each adapted to print a sixth color on the third carrier; and positioning the first printhead assembly, the second printhead assembly, and the third printhead assembly in-line, including fully overlapping the first printhead assembly, the second printhead assembly, and the third printhead assembly.

22. A method of printing, comprising:

ejecting a first color ink from a first plurality of printhead dies of a first printhead assembly;

ejecting a second color ink from a second plurality of printhead dies of the first printhead assembly;

ejecting a third color ink from a third plurality of printhead dies of a second printhead assembly; and ejecting a fourth color ink from a fourth plurality of printhead dies of the second printhead assembly.

23. The method of claim 22, wherein ejecting the first color ink, the second color ink, the third color ink, and the fourth color ink includes ejecting the first color ink and the third color ink within a first area while ejecting the second color ink and the fourth color ink within a second area.

24. The method of claim 23, wherein the first area and the second area overlap.

25. The method of claim 22, wherein the first plurality and the second plurality of printhead dies are mounted on a first carrier, and the third plurality and the fourth plurality of printhead dies are mounted on a second carrier.

26. The method of claim 22, further comprising:

ejecting the first color ink from an additional first plurality of printhead dies of an additional first printhead assembly;

ejecting the second color ink from an additional second plurality of printhead dies of the additional first printhead assembly;

ejecting the third color ink from an additional third plurality of printhead dies of an additional second printhead assembly; and ejecting the fourth color ink from an additional fourth plurality of printhead dies of the additional second printhead assembly.

27. The method of claim 26, wherein ejecting the first color ink, the second color ink, the third color ink, and the fourth color ink includes ejecting the first color ink from the first printhead assembly, the third color ink from the second printhead assembly, the fourth color ink from the additional second printhead assembly, and the second color ink from the additional first printhead assembly in a first order in a first direction, and ejecting the first color ink from the additional first printhead assembly, the third color ink from the additional second printhead assembly, the fourth color ink from the second printhead assembly, and the second color ink from the first printhead assembly in the first order in a second direction opposite the first direction.

28. The method of claim 22, further comprising:

ejecting a fifth color ink from a fifth plurality of printhead dies of a third printhead assembly; and ejecting a sixth color ink from a sixth plurality of printhead dies of the third printhead assembly.

29. A method of printing, comprising:

providing a plurality of in-line printhead assemblies each including a first plurality of printheads configured to print a first swath and a second plurality of printheads configured to print a second swath adjacent the first swath;

supplying different ones of black, cyan, magenta, and yellow inks to the first plurality of printheads of different ones of the printhead assemblies in a first order; and supplying different ones of black, cyan, magenta, and yellow inks to the second plurality of printheads of corresponding different ones of the printhead assemblies in a second order reversed from the first order.

30. The method of claim 29, further comprising:

supplying different ones of light cyan and light magenta inks to the first plurality of printheads of additional ones of the printhead assemblies in a third order, and supplying different ones of light cyan and light magenta inks to the second plurality of printheads of corresponding additional ones of the printhead assemblies in a fourth order reversed from the third order.

31. A printhead arrangement, comprising:

means for printing a first color and a second color with a first printhead assembly;

means for printing a third color and a fourth color with a second printhead assembly in-line with and fully overlapping the first printhead assembly; and means for printing the first color and the third color within a first area, and printing the second color and the fourth color within a second area adjacent the first area.

32. The printhead arrangement of claim 31, wherein means for printing the first color and the second color includes a first plurality of printhead dies each adapted to print the first color and a second plurality of printhead dies each adapted to print the second color, and wherein means for printing the third color and the fourth color includes a third plurality of printhead dies each adapted to print the third color and a fourth plurality of printhead dies each adapted to print the fourth color.

33. The printhead arrangement of claim 32, wherein the first plurality of printhead dies and the second plurality of printhead dies are mounted on a carrier of the first printhead assembly, and the third plurality of printhead dies and the fourth plurality of printhead dies are mounted on a carrier of the second printhead assembly.

34. The printhead arrangement of claim 32, wherein means for printing the first color and the third color within the first area includes substantially aligning the first plurality of printhead dies and the third plurality of printhead dies, and printing the second color and the fourth color within the second area includes substantially aligning the second plurality of printhead dies and the fourth plurality of printhead dies.

35. The printhead arrangement of claim 31, wherein the first area and the second area partially overlap.

* * * * *

UNITED STATES PATENT AND TRADEMARK OFFICE

CERTIFICATE OF CORRECTION

PATENT NO. : 7,093,926 B2
APPLICATION NO. : 10/620878
DATED : August 22, 2006
INVENTOR(S) : Antoni Gil It is certified that error appears in the above-identified patent and that said Letters Patent is hereby corrected as shown below:

In column 13, line 40, in Claim 10, after “first” delete “winthead” and insert -- printhead --, therefor.

In column 16, line 24, in Claim 30, after “order” delete “,” and insert -- ; --, therefor.

Signed and Sealed this

Twenty-first Day of April, 2009

John Doll

JOHN DOLL
*Acting Director of the United States Patent and Trademark Office*